US005775504A

United States Patent [19]

Menaged

[11] Patent Number: 5,775,504

[45] Date of Patent: Jul. 7, 1998

[54] MERCHANDISING PACKAGE

[76] Inventor: Neal M. Menaged, 1714 Fredendall Cir., South Hampton, Pa. 19006

[21] Appl. No.: 723,086

[22] Filed: Oct. 1, 1996

[51] Int. Cl.[6] ..... B65D 71/00

[52] U.S. Cl. ..... 206/495; 206/493; 206/806

[58] Field of Search ..... 206/736, 756, 206/493, 495, 303, 806

[56] References Cited

U.S. PATENT DOCUMENTS

| | | | |
|---|---|---|---|
| D. 353,092 | 12/1994 | Green . | |
| 2,696,295 | 12/1954 | Berry | 206/493 |
| 2,706,041 | 4/1955 | Tate | 206/493 |
| 3,486,615 | 12/1969 | Woskin . | |
| 4,261,462 | 4/1981 | Wysocki . | |
| 4,301,575 | 11/1981 | Goldberg | 206/493 |
| 4,518,086 | 5/1985 | Roccaforte . | |
| 4,949,845 | 8/1990 | Dixon . | |
| 5,090,568 | 2/1992 | Tse . | |
| 5,090,570 | 2/1992 | Todd . | |
| 5,121,835 | 6/1992 | Grupe . | |
| 5,593,025 | 1/1997 | Feibelman | 206/495 |

FOREIGN PATENT DOCUMENTS

| | | | |
|---|---|---|---|
| 35344 | 4/1886 | Germany | 206/495 |

OTHER PUBLICATIONS

Modern Packaging, 1972–73, p. 104.
Modern Packaging, 1963, p. 334.
Packaging, 8–1996, p. 53.

*Primary Examiner*—Paul T. Sewell
*Assistant Examiner*—Luan K. Bui

[57] ABSTRACT

A merchandising package of the type adapted to be displayed from a hanger includes a first elongated portion adapted to accommodate a first of the plurality of products for retail sale and a second elongated portion adapted to accommodate a second of the plurality of products for retail sale. The first and second elongated portions each include first and second laterally spaced apart edges. An intermediate portion interconnects the first and second elongated portions. In one form, the intermediate portion includes a single predetermined fold line. The predetermined fold line being operative for enabling the first and second elongated portions to be oriented substantially parallel to each other. The merchandising package also includes a first header portion longitudinally extending from the first elongated portion. The first header portion laterally extends beyond the first and second spaced apart edges of the first elongated portion. In an alternate form, the intermediate portion includes a pair of predetermined fold lines spaced longitudinally apart in a substantially parallel relationship.

16 Claims, 3 Drawing Sheets

MERCHANDISING PACKAGE

BACKGROUND OF THE INVENTION

1. Field of the Invention

In general, the present invention relates to a merchandising package. More particularly, the present invention relates to a merchandising package having first and second elongated portions for receiving product which may be oriented substantially parallel to one another.

2. Discussion

The modern self-service retail industry demands effective display of products while simultaneously minimizing floor space requirements. Distributors and retailers alike have long recognized the importance of maximizing the square foot area of retail display within a retail establishment. Self-service retail stores often incorporate display units for purposes of increasing display area. For example, one commonly used display unit is referred to in the industry as a gondola display unit. These units generally include a base portion, a wall portion upwardly extending from the base portion from which products can be displayed for retail sale, and a plurality of spaced apart upright supports attached to the wall portion. The wall portion is generally constructed from pegboard and includes a multiplicity of apertures equally spaced in rows and columns about its entire surface. Typically, the gondola display units are arranged end to end to define aisles throughout the interior of a store.

Gondola display units are generally constructed so that they may be utilized in one or two manners—as shelf-type units and as peg-type units. Determining the manner in which the unit is utilized is a function of the type and dimensions of products to be displayed. With the shelf-type units, shelves or racks are supported by shelving brackets attached to two adjacent upright supports. The shelf-type units are typically designed to permit an unobstructed view of products, to permit easy removal and replacement of the product on the display, and to provide sufficient inventory of products to limit the frequency of restocking the display.

When the gondola display unit is utilized as a peg-type unit, the product is suspended from pegs or similar type structure adapted to removably engage one or more apertures in the pegboard surface. The pegs are designed to releasably suspend a sufficient supply of product so as to limit the frequency of restocking. Peg-type units provide a significant degree of flexibility to readily accept various sized product for retail sale and are generally preferred unless weight and size considerations of the product to be displayed render it impractical to suspend the product from a peg.

In an attempt to further increase the display capacity of retail establishments, various techniques and devices have been utilized. However, improvements to the merchandising packages have been generally disregarded. Conventional packaging used in modern retail merchandising is predominantly dictated by the size, shape and quantity of the product to be displayed. In certain applications, product is directly attached to cardboard stock constructed to include an aperture so that the product can be displayed from a peg. This type of packaging is generally limited for use with product that cannot be inadvertently or easily removed from the cardboard stock.

Prior merchandising packages have generally proven satisfactory for the display of product in self-service retail stores. However, none are without their drawbacks and/or limitations. For example, known merchandising package constructions are not capable of accommodating product on two oppositely facing sides. Further, known merchandising package construction do not permit display in alternate manners to accommodate particular retail space requirements.

Accordingly, it has been one object of the present invention to provide a merchandising package which holds an increased amount of product within a defined display area.

It is another object of the present invention to provide a merchandising package operable to effectively display products simultaneously on two oppositely facing sides.

It is yet another object of the present invention to provide a merchandising package which is cost efficient to manufacture and which can be easily assembled.

Still another object of the present invention is to provide a merchandising display package which can be folded over on itself and suspended in such a folded condition.

SUMMARY OF THE INVENTION

In a preferred embodiment, the present invention is directed to a merchandising package for displaying a plurality of products for retail sale. The merchandising package includes a first elongated portion adapted to accommodate a first of the plurality of products for retail sale and a second elongated portion adapted to accommodate a second of the plurality of products for retail sale. The first and second elongated portions each include first and second laterally spaced apart edges. The preferred embodiment additionally includes an intermediate portion interconnecting the first and second elongated portions. The intermediate portion preferably includes first and second predetermined fold lines. The first and second predetermined fold lines are oriented substantially parallel to one another and spaced apart in a longitudinal direction. The first and second predetermined fold lines permit the first and second elongated portions to be oriented substantially parallel to each other and spaced apart from each other. The preferred embodiment further includes a first header portion longitudinally extending from the first elongated portion. The first header portion laterally extends beyond the first and second laterally spaced apart edges of the first elongated portion. The present invention is preferably adapted to be suspended from a peg or similar structure.

In an alternative embodiment, the present invention is similarly directed to a merchandising package for displaying a plurality of products for retail sale. The merchandising package is unitarily constructed from a planar material and Includes first and second elongated portions substantially identical in construction to corresponding features of the preferred embodiment. An intermediate portion interconnects the first and second elongated portions which includes a single predetermined fold line. The first predetermined fold line is arranged for enabling the first and second elongated portions to be oriented substantially parallel to each other. As with the preferred embodiment, the alternative embodiment similarly includes at least a first header portion longitudinally extending from the first elongated portion.

BRIEF DESCRIPTION OF THE DRAWINGS

Various advantages of the present invention will become apparent to one skilled in the art after reading the following specification and subjoined claims and by referencing the following drawings in which:

FIG. 6 is a front view of an alternative embodiment of a merchandising package constructed in accordance with the teachings of the present invention; and FIG. 7 is a side view of the merchandising package of FIG. 6.

DETAILED DESCRIPTION OF THE PRESENT EMBODIMENT

Figure 1:
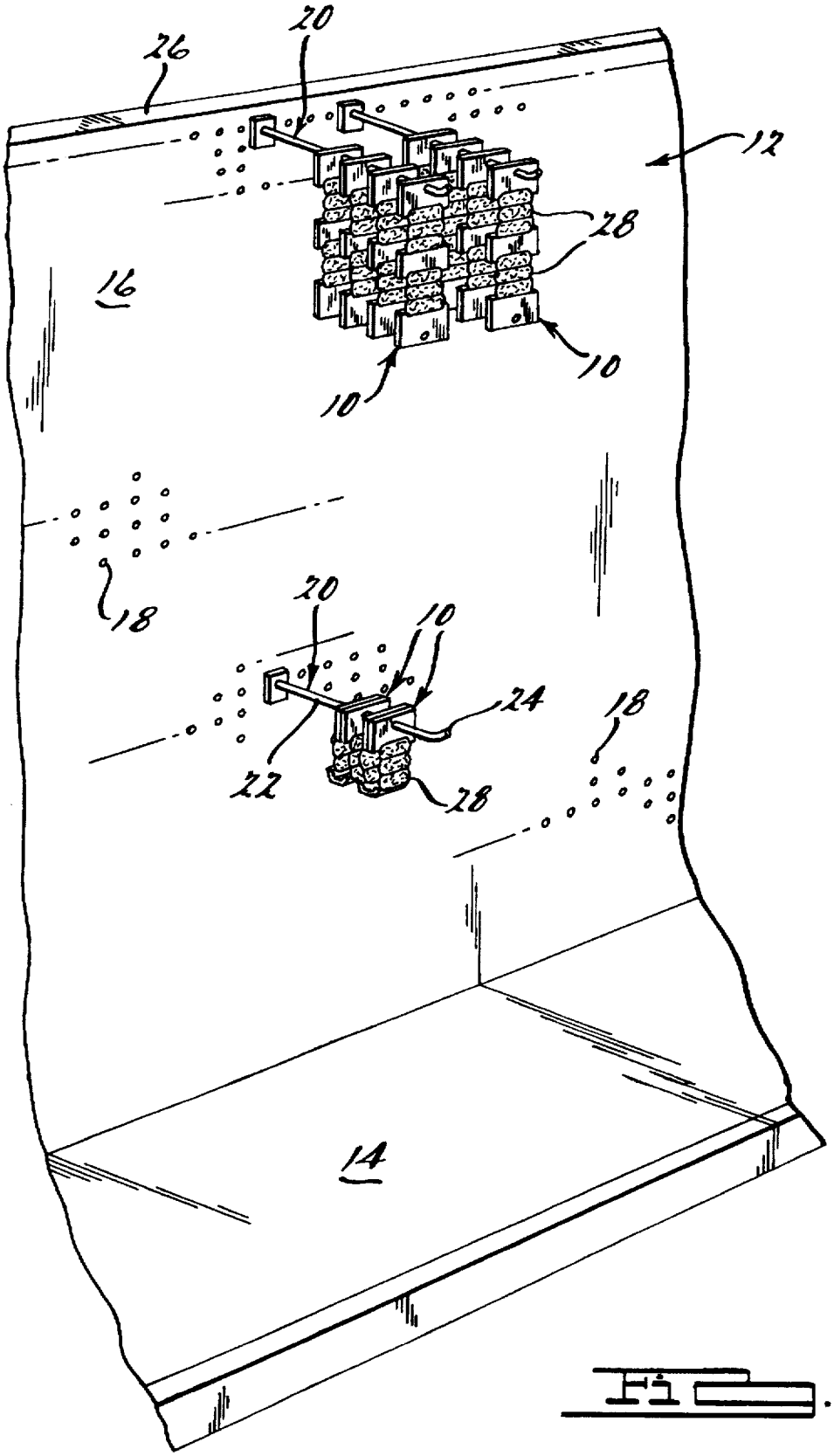
FIG. 1 is a perspective view of retail display including merchandising packages constructed in accordance to the teachings of the present invention.
Figure 2:
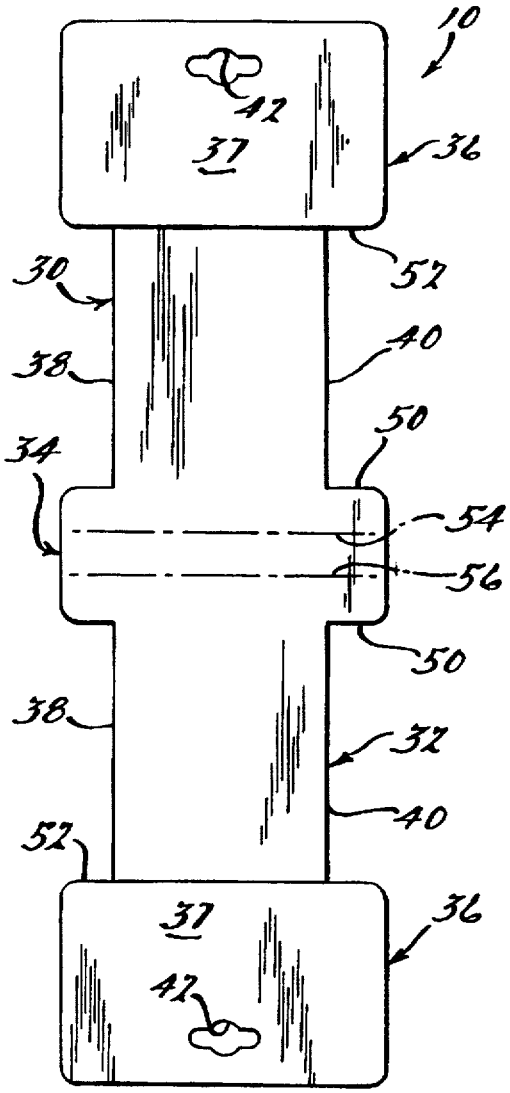
FIG. 2 is an enlarged front view of one of the merchandising packages of FIG. 1 shown in an unfolded condition and with the merchandise removed for clarity of illustration.

The present invention provides a merchandising package for the retail display of products. While shown throughout the drawings in two embodiments specifically adapted to be suspended from hangers or similar structure, those skilled in the art will appreciate that the invention is not so limited in scope. In this regard, the teachings of the present invention will be understood to be readily adaptable for use in virtually any type of retail display in which it is desirable to suspend product from two opposing sides of a package.

Turning to the drawings in which identical or equivalent elements have been denoted with like reference numerals, an exemplary embodiment of a merchandising package embodying the teachings of the present invention is illustrated and has been identified generally at reference numeral 10. Prior to describing the construction and operation of the merchandising package 10 of the present invention, a brief understanding of the exemplary use environment shown in FIG. 1 is warranted.

With reference to FIG. 1, the merchandising package 10 of the present invention is shown operatively arranged with a gondola unit 12. The gondola unit 12 is of generally conventional construction including a base 14 and an upwardly extending display wall 16. As shown, the display wall 16 comprises a pegboard wall formed to include rows and columns of equally spaced apart apertures 18. In a conventional manner, two or more of the apertures 18 cooperate to releasably receive a hanger or peg 20 or other similar structure adapted to releasably suspend retail products. The hanger 20 includes a forwardly extending rod portion 22 which is angled upwardly at its distal end 24 to prevent inadvertent removal of the product from the hanger 20.

The merchandising package 10 of the present invention is shown in FIG. 1 in its two distinct operating modes—an unfolded mode and a folded mode. Adjacent an upper edge 26 of the pegboard wall 16, a pair of hangers 20 are loaded with merchandising packages 10 of the present invention in their unfolded mode. As such, the products 28 carried by the merchandising package 10 consume a larger area which is visible to the consumer. On the lowermost hanger 20 illustrated in FIG. 1, a pair of merchandising packages 10 constructed in accordance with the teachings of the present invention are releasably suspended in a folded condition. As such, a smaller visual area is occupied, thereby permitting a greater number of packages 10 to occupy the retail space visable to the consumer.

Referring now generally to FIGS. 2–5, the preferred embodiment of the present invention will now be described in detail. As illustrated, the merchandising package of the preferred embodiment of the present invention is constructed to include first and second elongated portions 30 and 32, an intermediate portion 34 and at least one header portion 36. In the preferred embodiment, the merchandising package 10 is unitarily constructed of cardboard or other like sheet material having suitable strength characteristics. However, it will be appreciated by those skilled in the art that any sufficiently flexible material can be incorporated.

The first and second elongated portions 30 and 32 each is formed to include a pair of laterally spaced apart edges 38 and 40. As illustrated, the laterally spaced apart sides 38 and 40 are preferably substantially parallel to one another.

As noted above, the merchandising package 10 of the present invention preferably includes at least one header portion 36. In the exemplary embodiment illustrated, the merchandising package 10 includes two header portions 36—one header portion 36 located at each of the opposite ends of the first and second elongated portions 30 and 32. It will be readily appreciated by one skilled in the art that the merchandising package may only incorporate a single header portion 36. In such a construction, one of the first and second elongated embodiments 30 and 32 may simply extend longitudinally and terminate.

Figure 3:
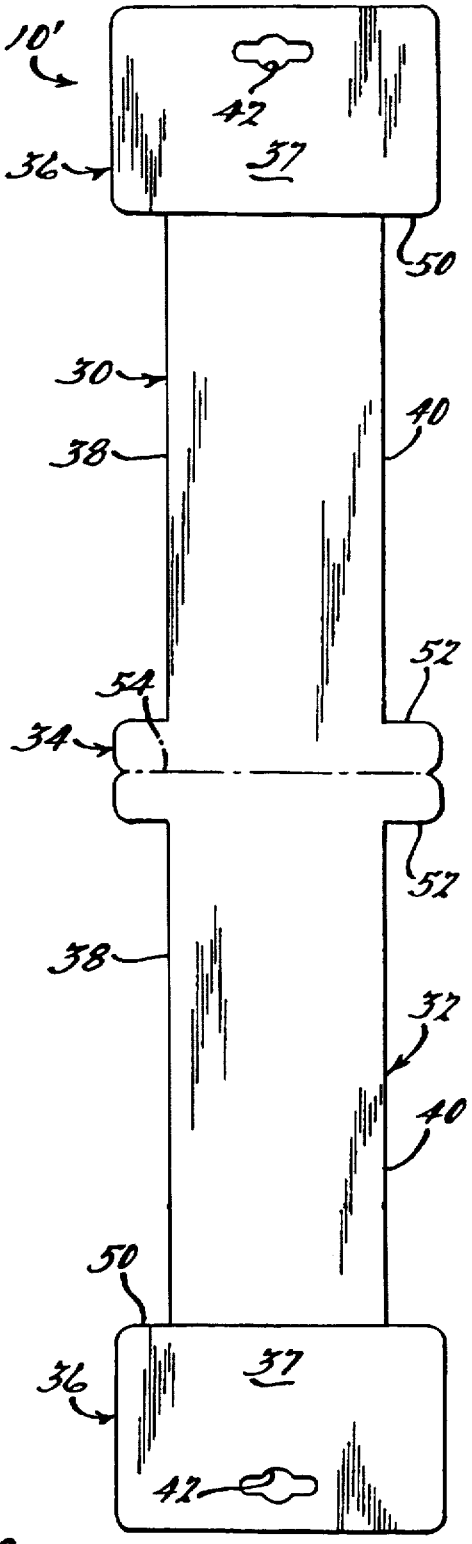
FIG. 3 is a side view of the merchandising package of FIG. 2.
Figure 3:
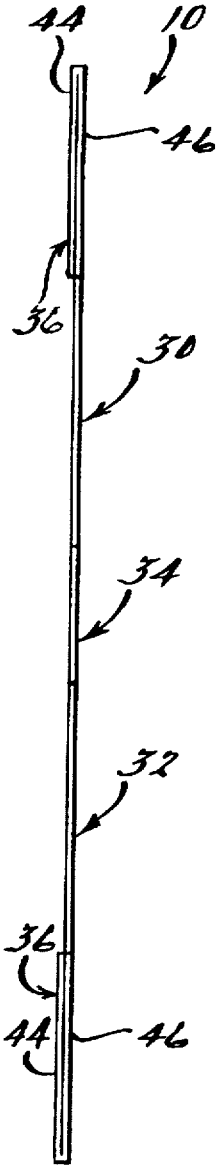
Figure 2:
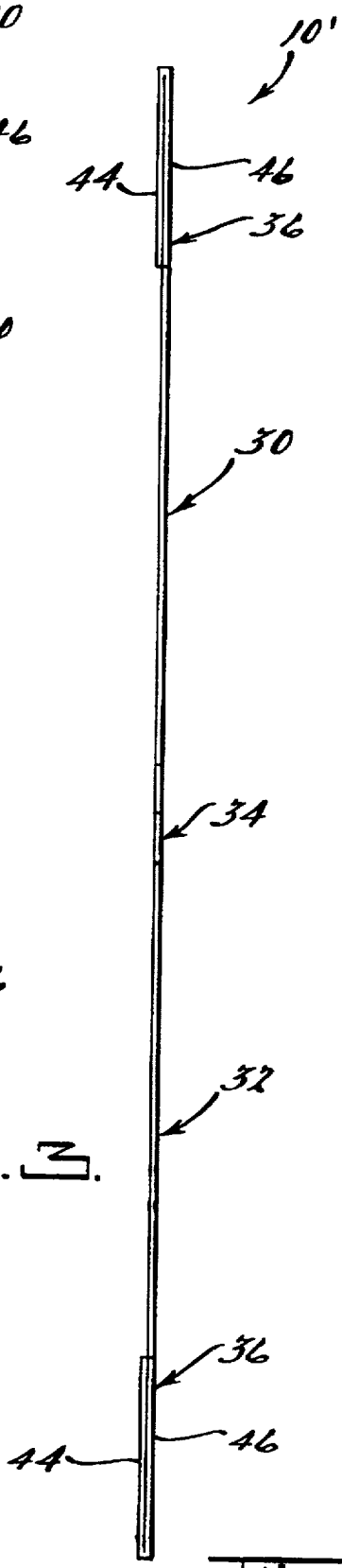

In the exemplary embodiment illustrated, each of the header portions 36 is generally rectangular in shape and includes an aperture 42 sized to receive one of the hangers 20 of the display unit 12. The apertures 42 are located so as to align when the merchandising package 10 is folded (as shown in FIGS. 1 and 3). The header portions 36 define a message area 37 on which product information can be displayed. For example, the message area 37 of one of the header portions 36 may include primary advertising, such as product trademarks. The message area 37 of the other header portion 36 may include secondary advertising, bar code information, manufacturer identification, and the like.

Figure 4:
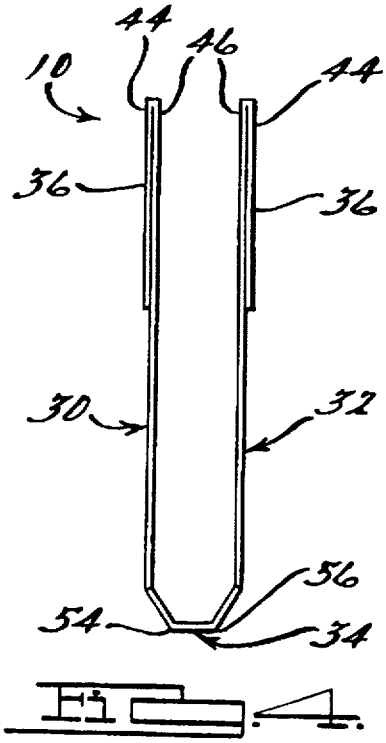
FIG. 4 is a side view of the merchandising package of FIG. 2 shown in a folded condition.

As seen most dearly in the side views of FIGS. 3 and 4, the header portions 36 of the merchandising package 10 include a first layer 44 which has been folded back over on top of a second layer 46. In another preferred embodiment, these two layers 44 and 46 are glued or otherwise suitably attached to one another. The two layers 44 and 46 provide additional strength to prevent tearing of the header portion 36 as the merchandising package 10 is suspended from the hanger 20. However, It will be appreciated by those skilled in the art that most applications will not require the double layers.

In the exemplary embodiment illustrated, the intermediate portion 34 is substantially rectangular in shape and includes a uniform width which is greater than the width of the first and second elongated portions 30 and 32. As can best be seen in FIG. 2, the larger width of the intermediate portion 34 provides a lower flange-like surface 50 (when the merchandising package 10 is in a folded condition) immediately adjacent both of the first and second elongated portions 30 and 32. Similarly, the width of the first and second header portions 36 is greater than the width of the first and second elongated portions, thereby providing an upper flange-like surface 52 adjacent an upper end of each of the first and second elongated portions 30 and 32.

Figure 5:
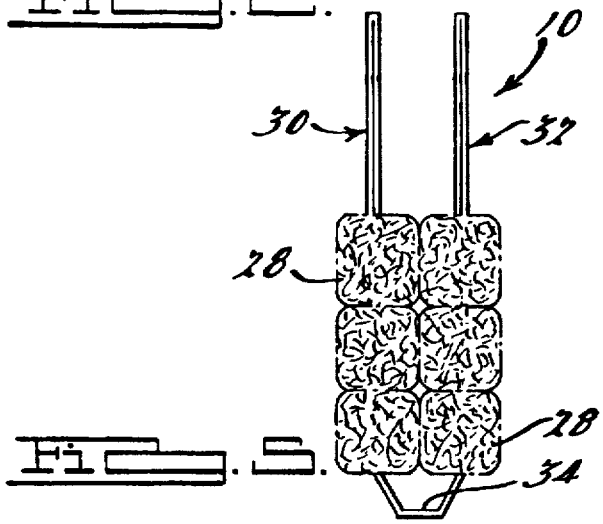
FIG. 5 is a side view of the merchandising package of FIG. 2 shown in a folded position and further shown with merchandise position thereon.

The reduced width of the first and second elongated portions 30 and 32 and the upper and lower flange-like surfaces 50 and 52 are specifically adapted to retain a plurality of memory retaining hair accessories 28, such as the type marketed by L&N Sales and Marketing, Inc., Huntingdon Valley, Pa. under the registered trademark Scunci®, as shown in FIGS. 1 and 5. However, it will be appreciated by those skilled in the art that the teachings of the present invention are not limited to an embodiment including such a reduced width portion 30 and 32. In this regard, the merchandising package 10 may include an elongated portion from which the product 28 can be directly affixed or alternatively retained within cooperative packaging.

The intermediate portion 34 is formed to preferably include first and second predetermined fold lines 54 and 56. The first and second predetermined fold lines 54 and 56 are parallel to one another, longitudinally spaced apart and extended across the width of the intermediate portion 34. In the preferred embodiment, the first and second fold lines 54 and 56 segment the merchandising package 10 into two end sections which are interconnected by the intermediate portion 34. In use, the merchandising package 10 is folded at the predetermined fold lines 54 and 56 until the first and second elongated portions 30 and 32 are oriented parallel to one another. By providing a pair of parallel and spaced apart fold lines 54 and 56, the merchandising package 10 permits the parallel elongated portions 30 and 32 to be spaced apart. As a result, the merchandising package 10 more readily accommodates a product 28 having a significant width.

Turning to FIGS. 6 and 7, an alternative embodiment of the present invention is illustrated. For ease of reference, features of the second embodiment common to the preferred embodiment are identified with like reference numerals. Similar to the preferred embodiment, the alternative embodiment of the present invention is drawn to a merchandising package 10' of the type adapted to be displayed from a hanger 20. With the exception of the intermediate portion 34, the alternative embodiment is substantially identical to the preferred embodiment and need not be further described.

The intermediate portion 34 of the alternative preferred embodiment includes two elongated portions 30 and 32 connected along a single predetermined fold line 54. The two elongated portions 30 and 32 are arranged to be folded through approximately 180° with respect to each other. As a result, if a plurality of memory retaining hair accessories are disposed on the article display portions (as shown in FIGS. 1 and 3) with respect to the preferred embodiment, the flexibility of the elongated portions 30 and 32 permits the merchandising package 10' to bow slightly outwardly.

The alternative embodiment also departs from the preferred embodiment in that the elongated portions 30 and 32 have been longitudinally extended. This departure is considered, however, to be a mere matter of design choice. In this regard, it is anticipated that similar types of dimensional alterations may be made to the subject invention.

The foregoing discussion discloses and describes merely exemplary embodiments of the present invention. One skilled in the art will readily recognize from such discussion and from the accompanying drawings and claims that various changes and modifications can be made therein without departing from the spirit and scope of the invention as defined in the following claims. Furthermore, as alluded to above, it will be appreciated by those skilled in the art that the relative dimensions are merely exemplary and can be readily modified to accommodate products of various sizes and shapes.

What is claimed is:

1. A merchandising package for displaying a plurality of products for retail sale, the merchandising package comprising:

a first elongated portion for holding a first of the plurality of products for retail sale in an encircling relationship;

a second elongated portion for holding a second of the plurality of products for retail sale in an encircling relationship:

said first and second elongated portions each including first and second spaced apart edges;

an intermediate portion interconnecting said first and second elongated portions; and a first header portion interconnected to said first elongated portion, said header portion laterally extending beyond the first and second spaced apart edges of the first elongated portion, said intermediate portion including a first predetermined fold line, said first predetermined fold line being arranged for enabling said first and second elongated portions to be substantially parallel to each other said merchandising package being generally symmetrical about a longitudinal centerline.

2. The merchandising package of claim 1, wherein said merchandising package is unitarily constructed.

3. The merchandising package of claim 2, wherein the merchandising package is substantially flexible.

4. The merchandising package of claim 1, further comprising a second header portion longitudinally extending from said second elongated portion, said second header portion laterally extending beyond said first and second laterally spaced apart edges of said second elongated portion.

5. The merchandising package of claim 1, wherein said intermediate portion further comprises a second predetermined fold line, said second predetermined fold line being longitudinally spaced apart from and disposed substantially parallel to said first predetermined fold line.

6. The merchandising package of claim 1, wherein said intermediate portion laterally extends beyond the first and second laterally spaced apart edges of said first and second elongated portions.

7. The merchandising package of claim 2, wherein the merchandising package is constructed of cardboard.

8. A merchandising package for displaying a plurality of products for retail sale, the merchandising package comprising:

a first elongated portion for holding a first of the plurality of products for retail sale in an encircling relationship;

a second elongated portion for holding a second of the plurality of products for retail sale in an encircling relationship;

said first and second elongated portions including first and second laterally spaced apart edges;

an intermediate portion interconnecting said first and second elongated portions, said intermediate portion including a predetermined fold line, said first predetermined fold line being arranged for enabling said first and second elongated portions to be oriented substantially parallel to each other; and a first header portion longitudinally extending from said first elongated portion, said first header portion laterally extending beyond said first and second laterally spaced apart edges of said first elongated portion, said merchandising package being generally symmetrical about a longitudinal centerline.

9. The merchandising package of claim 8, wherein said merchandising package is unitarily constructed.

10. The merchandising package of claim 9, wherein the merchandising package is substantially flexible.

11. The merchandising package of claim 8, further comprising a second header portion longitudinally extending from said second elongated portion, said second header portion laterally extending beyond said first and second laterally spaced apart edges of said second elongated portion.

12. The merchandising package of claim 8, wherein said intermediate portion further comprises a second predetermined fold line, said second predetermined fold line being longitudinally spaced apart from and disposed substantially parallel to said first predetermined fold line.

13. The merchandising package of claim 8, wherein said intermediate portion laterally extends beyond the first and second laterally spaced apart edges of said first and second elongated portions.

14. The merchandising package of claim 10, wherein the merchandising package is constructed of cardboard.

15. A merchandising package for displaying a plurality of products for retail sale, the merchandising package comprising:

a first elongated portion for holding a first of the plurality of products for retail sale in an encircling relationship;

a second elongated portion for holding a second of the plurality of products for retail sale in an encircling relationship:

said first and second elongated portions including first and second laterally spaced apart edges;

an intermediate portion interconnecting said first and second elongated portions, said intermediate portion including a first predetermined fold line, said first predetermined fold line being arranged for enabling said first and second elongated portions to be oriented substantially parallel to each other, said intermediate portion laterally extending beyond said first and second laterally spaced apart edges of said first and second elongated portions;

a first header portion longitudinally extending from said first elongated portion;

a second header portion longitudinally extending from said second elongated portion; and said first and second header portions laterally extending beyond said first and second laterally spaced apart edges of said first and second elongated portions, respectively;

said merchandising package being generally symmetrical about a longitudinal centerline.

16. The merchandising package of claim 15, wherein the merchandising package is constructed of cardboard.

* * * * *